US006317939B1

(12) United States Patent
Malin

(10) Patent No.: US 6,317,939 B1
(45) **Date of Patent: *Nov. 20, 2001**

(54) HIGH INTERNAL FORCE RESISTANT PEEL SEALABLE ZIPPER

(75) Inventor: Art Malin, Northbrook, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/694,158

(22) Filed: Oct. 23, 2000

Related U.S. Application Data

(62) Division of application No. 09/564,420, filed on May 4, 2000, now Pat. No. 6,183,134.

(51) Int. Cl.[7] ..... B65D 33/00
(52) U.S. Cl. ..... 24/304; 24/585.12
(58) Field of Search ..... 24/587, 304, 399, 24/30.5 R, 400; 383/61, 21, 63, 211, 64, 203; 428/99, 100

(56) References Cited

U.S. PATENT DOCUMENTS

| | | | |
|---|---|---|---|
| 4,925,316 | * | 5/1990 | Van Erden et al. . |
| 5,470,156 | | 11/1995 | May . |
| 5,474,382 | | 12/1995 | May . |
| 5,486,051 | | 1/1996 | May . |
| 5,492,411 | | 2/1996 | May . |
| 5,509,735 | | 4/1996 | May . |
| 5,513,915 | | 5/1996 | May . |
| 5,551,127 | | 9/1996 | May . |
| 5,604,000 | | 2/1997 | May . |
| 5,660,749 | * | 8/1997 | May et al. . |
| 5,672,009 | | 9/1997 | Malin . |
| 5,725,312 | | 3/1998 | May . |
| 5,774,954 | * | 7/1998 | Ramsey et al. . |
| 5,827,163 | | 10/1998 | Kettner . |
| 5,832,570 | * | 11/1998 | Thorpe et al. . |
| 5,930,877 | * | 8/1999 | Thorpe et al. . |
| 5,964,532 | | 10/1999 | St. Phillips et al. . |
| 6,131,248 | * | 10/2000 | Tomic . |
| 6,183,134 | * | 2/2001 | Malin . |

* cited by examiner

*Primary Examiner*—James R. Brittain
(74) *Attorney, Agent, or Firm*—Pitney, Hardin, Kipp & Szuch LLP

(57) ABSTRACT

A zipper assembly is provided having first and second interlocking members respectively on first and second base strips. A first connect strip is secured to the first base strip and a second connect strip is secured to the second base strip. An extension of the second connect strip extends beyond the first connect strip when the interlocking members are engaged and a peel-sealable material is provided on the extension. A bag incorporating the zipper has the first connect strip attached to a first bag wall, the second connect strip attached to an opposite bag wall and the peels sealable material sealed to the first bag wall. A slider may be provided about the interlocking members.

9 Claims, 1 Drawing Sheet

HIGH INTERNAL FORCE RESISTANT PEEL SEALABLE ZIPPER

RELATED APPLICATIONS

The present application is a divisional of application Ser. No. 09/564,420 filed May 4, 2000 and now U.S. Pat. No. 6,183,134.

BACKGROUND OF THE INVENTION

1. Field of the Invention

This invention pertains to a reclosable zipper for plastic bags which includes a peel-sealable member for attachment to the bag wall and for which a high internal force is required to open the peel seal.

2. Description of the Prior Art

In the prior art, there are a variety of reclosable bags in which the zipper interlock is augmented by a breakable or peelable seal for hermetic and/or tamper evident sealing purposes. In one such zipper a single extended flange is secured permanently to one wall and by a peelable or breakable connection to the other wall. In a double flange configuration the peel seal extends between the two flanges of the zipper. A third configuration provides the peel seal directly between the bag walls.

Such prior art however has not provided a suitable hermetic and/or tamper evident seal having a high resistance to internal opening forces which are required for many applications such as, for example where the zipper is to be used on so-called "pillow" package for chips or the like or where heavier content packages require a greater resistance to opening. As reclosable bags are used as primary packaging for an ever wider variety of products, numerous laminated films are being used for the bag material. This raises the problem of zipper-film compatibility. That is, the material used to form a zipper sealable to a film used to line a chip package may not be sealable to the film used to line a package for some other food, such as a cheese. While materials exist that are virtually universally compatible with bag films, such materials do not readily lend themselves to being extruded in the relatively complex shapes of zipper profiles.

Prior art references include U.S. Pat. No. 5,964,532 entitled "Reclosable Fastener Strip with Tamper Evident Feature" issued on Oct. 12, 1999 to St. Phillips et al.; U.S. Pat. No. 5,827,163 entitled "Method Making a Closure Arrangement for Attachment to Outside of a Bag" issued on Oct. 27, 1998 to Kettner; U.S. Pat. No. 5,725,312 entitled "Closure Arrangement Having a Peelable Seal" issued on Mar. 10, 1998 to May; U.S. Pat. No. 5,672,009 entitled Reclosable Pouch and Zipper Therefor" issued on Sep. 30, 1997 to the inventor of the present invention; U.S. Pat. No. 5,604,000 entitled "Heat-Sealable Peelable Composition" issued on Feb. 18, 1997 to May; U.S. Pat. No. 5,551,127 entitled "Closure Arrangement Having a Peelable Seal" issued on Sep. 3, 1996 to May; U.S. Pat. No. 5,513,915 entitled "Closure Arrangement Having a Breakaway Seal" issued on May 7, 1996 to May; U.S. Pat. No. 5,509,735 entitled "Closure Arrangement Having a Peelable Seal" issued on Apr. 23, 1996 to May; U.S. Pat. No. 5,492,411 entitled "Tamper Evident Peelable Seal" issued on Feb. 20, 1996 to May; U.S. Pat. No. 5,486,051 entitled "Closure Arrangement having a Breakaway Seal" issued on Jan. 23, 1996 to May; U.S. Pat. No. 5,474,382 entitled "Closure Arrangement having a Peelable Seal" issued on Dec. 12, 1995 to May; and U.S. Pat. No. 5,470,156 entitled "Closure Arrangement Having a Peelable Seal" issued on Nov. 28, 1995 to May.

U.S. Pat. No. 5,509,735 typifies the prior art in many respects and highlights the short comings of the prior art. Thus, since the profiles disclosed are joined directly to the inner surface of the bag walls, the profiles must be formed of a material that is sealable to the bag film. In addition, the peelable seal is directly subjected to the bag internal forces and hence the force the consumer must apply to break the peelable seal is the same as the internal forces of the package which the peelable seal must resist. The package must thus be made difficult for the consumer to open or the integrity of the package may be compromised.

OBJECTS AND SUMMARY OF THE INVENTION

In view of the above it is an object of the present invention to provide a zipper arrangement in which a peel seal is assisted in withstanding internal forces of the package.

A further object is to provide a zipper arrangement in which a peel seal is provided which can withstand relatively high internal package forces but which can be opened from the consumer side with a relatively low force.

A still further object is to provide a zipper arrangement which is compatible with a wide variety of films.

Still another object is to provide a zipper which may be used with a slider to assist in opening and closing.

The above and other beneficial objects and advantages are attained by providing a zipper having first and second interlocking members respectively on first and second base strips. A first connect strip is secured to the first base strip and a second connect strip is secured to the second base strip. An extension of the second connect strip extends beyond the first connect strip when the interlocking members are engaged and a peel sealable material is provided on the extension. The connect strips are formed of a sealable material or coated with such a material.

When incorporated into a bag, the first connect strip is sealed to a first wall and the second connect strip is secured to the opposite wall. The peel seal is also sealed to the first wall spaced toward the contents side of the bag, apart from the points at which the connect strips are attached. This results in a hinged attachment for the peel seal so that any internal force within the bag will tend to urge the second strip extension and hence the peel seal toward the wall to which the peel seal is attached, thereby enhancing the holding force of the peel seal. In addition, the hinged attachment converts much of the force acting on the peel seal to a shear force to which peel seals have a greater resistance.

BRIEF DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENTS

Figure 1:
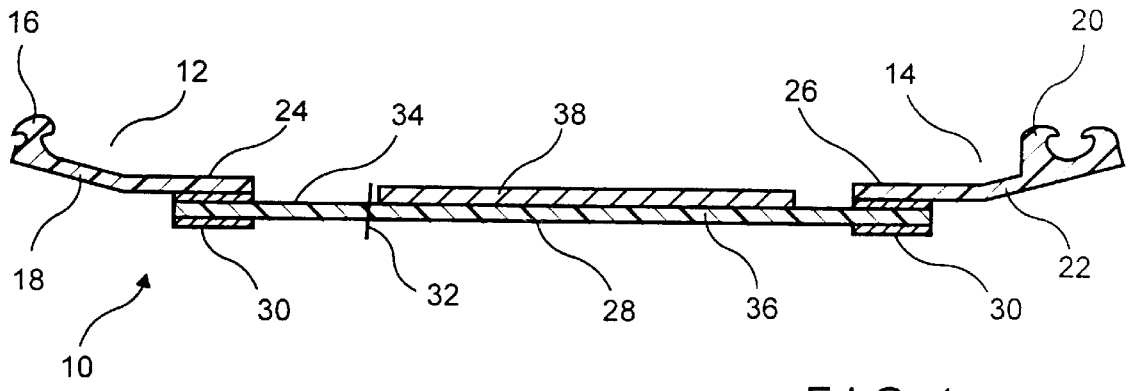
FIG. 1 is a sectional view of first and second profiles of a zipper attached to a connecting member.

Reference is now made to the drawings and to FIG. 1 in particular wherein a zipper assembly 10 is shown comprising a male profile 12 and a female profile 14. The male profile 12 includes a male interlocking element 16 extending from a base strip 18. The female profile 14 includes a female interlocking element 20 extending from a base strip 22. Flanges 24, 26 may be provided on one side of the male and female profiles, respectively, and included in the base strip. The design of the interlocking elements 16, 20 may be any of many designs that are well known by those skilled in the art and may be designed so as to be used with or without a slider. Likewise the profiles 12, 14 may be formed by conventional extrusion means used to form such zippers and of conventional materials, such as polyethylene which is readily extrudable into the interlocking shapes and usually used to form plastic zippers.

Polyethylene is also commonly used for the body of plastic reclosable storage bags and hence polyethylene zipper may readily be heat sealed to such bag walls. A problem arises, however, where the bag is proposed to be used as primary packaging, particularly for foods. In such cases the bag wall is usually formed of a single layer or laminate film that exhibits particular desired properties, for example, as barriers to air, moisture, odor, oils or the like. The problem arises when the surface of the packaging to which the zipper is to be bonded is formed of a material that is not readily heat sealable to the polyethylene zipper material. This makes it difficult to provide a commodity zipper to different potential customers since the zipper material must be matched to the bag material. To avoid this problem, the present invention provides for a connect member to be interposed between the zipper profiles and bag walls. The connect member is formed of or coated with a sealant such as EVA enabling it to be readily sealed to a variety of bag films.

As shown in FIG. 1 connect member 28 is provided extending between flanges 24, 26 and connected to both. As noted, the connecting member may be formed of a sealant material such as EVA or, alternatively may be formed of a conventional plastic, such as polyethylene, and carry a sealant 30 on select portions. The connecting member 28 is divided by a perforation line 32 into a first connecting strip 34 and a second connecting strip 36. The perforation line 32 is off set to one side of connecting member 28 so that the second connecting strip 36 is substantially larger than the first connecting strip 34. A peel sealable material 38 is provided on the second connecting strip 36.

Figure 2:
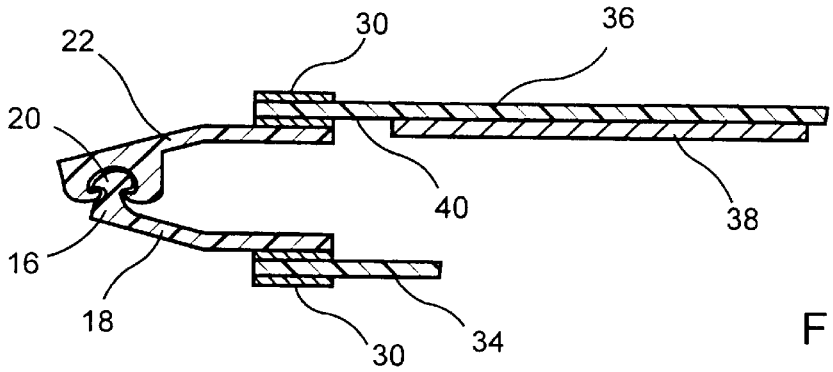
FIG. 2 is a sectional view depicting the interlocking members of the zipper profiles engaged and the connecting member separated into first and second connect strips attached respectively to the first and second profiles; and, FIG. 3 is a sectional view of a bag wherein the zipper connecting members and peel sealable material are shown attached to the bag walls.

As shown in FIG. 2, prior to attachment to a bag film the zipper strip 10 is folded to bring the male and female profile interlocks 16, 20 into engagement and to break the connecting member 28 at the perforation line 32. With the profiles joined, it can be seen that an extended portion 40 of the second connecting member extends beyond the first connecting member 34 and that the peel seal material 38 is disposed at the distal end of the extended portion spaced from the profiles.

Figure 3:
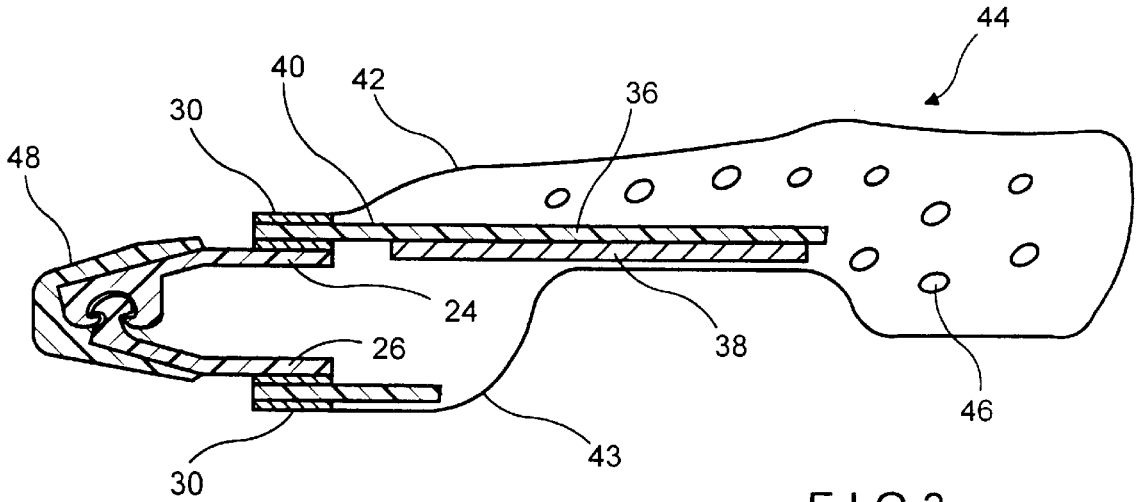

FIG. 3 depicts a bag 44 incorporating the zipper assembly 10 with the zipper assembly 10 at the top of the bag positioned between bag walls 42, 43. In this view a slider 48 is positioned about the profiles to facilitate opening and closing of the bag. As shown, first connecting strip 34 and second connecting strip 36 are connected to their respective walls 42, 43 through the sealant 30 or, if the connecting strip material is sealable to the inner laminate of the walls, the connecting strips may be sealed directly to the walls. The sealant 30 may be chosen for a having a particular affinity to the inner laminate of the bag walls or may be a general sealable material such as EVA. The peel-seal material 38 is also secured to the inner surface of bag wall 43 while the extension 40 of the second strip 36 is free of attachment to either wall. As a result of the peel-sealable material being cantilevered at the end of the extended flange portion 40 of the second connecting member, the peel seal is better able to withstand internal opening forces of the package 44 since much of the force acting on the peel seal is a shear force. In addition, as a result of the hinged connection the internal force of the package tends to urge the peel-sealable material toward wall 43 enhancing the bond rather than away from wall 43.

Thus, in accordance with the above, the aforementioned objectives are effectively attained. It will be appreciated by those skilled in the art that various changes may be made without departing from the spirit and scope of the present invention. For example numerous designs are known for the interlocking elements. Further, if the interlocking elements are to be opened by pulling them apart rather than through the use of a slider, pull flanges may be provided above the interlocking elements.

Having thus described the invention, what is claimed is:

1. A zipper comprising:

a first profile having a first interlocking member on a surface of a first base strip;

a second profile having a second interlocking member, engageable with said first interlocking member, on a surface of a second base strip;

a first connect strip secured to a surface of said first base strip below said first interlocking member;

a second connect strip having a surface secured to a surface of said second base strip below said second interlocking member; an extension of said second connect strip extending beyond said first connect strip when said interlocking members are engaged; and, a peel-sealable material on the surface of said second connect strip and disposed on said extension.

2. The zipper of claim 1 wherein said first base strip includes a flange and said first connect strip is secured to said first base strip flange.

3. The zipper of claim 2 wherein said second base strip includes a flange and said second connect strip is secured to said second base strip flange.

4. The zipper of claim 3 wherein said second interlocking member is spaced from said second base strip flange.

5. The zipper of claim 2 wherein said first connect strip extends beyond said first base strip flange.

6. The zipper of claim 2 wherein said first interlocking member is at an end of said first base strip spaced from said first base strip flange.

7. The zipper of claim 1 wherein at least portions of said second connect strip spaced from said peel-sealable material includes a sealant material on a surface opposite to that bearing the peel sealable material.

8. The zipper of claim 1 wherein at least a portion of said first connect strip includes a sealant material on a surface opposite to that secured to said first base strip.

9. The zipper of claim 1 wherein said zipper includes a slider disposed for movement along said interlocking members.

* * * * *